US005323673A

United States Patent [19]

Martinez et al.

[11] Patent Number: 5,323,673

[45] Date of Patent: Jun. 28, 1994

[54] NUT AND BOLT HOLDER FOR SOCKET WRENCHES

[76] Inventors: Florence S. Martinez; Rosendo Martinez, both of 790 Prigge Rd., St Louis, Mo. 63138

[21] Appl. No.: 77,816

[22] Filed: Jun. 15, 1993

Related U.S. Application Data

[63] Continuation-in-part of Ser. No. 908,065, Jul. 6, 1992, abandoned.

[51] Int. Cl.[5] ..... B25B 13/06

[52] U.S. Cl. ..... 81/125; 81/13

[58] Field of Search ..... 81/13, 125, 180.1, 456, 81/457, 458

[56] References Cited

U.S. PATENT DOCUMENTS

| | | | |
|---|---|---|---|
| 2,273,861 | 2/1942 | Green | 81/457 |
| 2,367,480 | 1/1945 | Beswick | 81/125 X |
| 2,770,157 | 11/1956 | Moreo | 81/125 |
| 2,930,267 | 3/1960 | Apicelli | 81/125 X |
| 3,005,367 | 10/1961 | Vose | 81/125 |
| 3,145,595 | 8/1964 | Mauck | 81/125 |
| 3,151,512 | 10/1964 | Charczenko | 81/125 X |
| 3,379,078 | 4/1968 | Sallows | 81/125 |
| 3,630,107 | 12/1971 | Carr | 81/125 |
| 4,060,113 | 11/1977 | Matsushima | 81/125 |
| 4,744,273 | 5/1988 | Bartok, Jr. | 81/125 X |
| 5,074,172 | 12/1991 | Fetter et al. | 81/125 |
| 5,146,814 | 9/1992 | Vasiclek | 81/125 |

FOREIGN PATENT DOCUMENTS

| | | | |
|---|---|---|---|
| 217581 | 3/1925 | United Kingdom | 81/125 |

*Primary Examiner*—D. S. Meislin

[57] ABSTRACT

Nut and bolt holder sockets for standard socket wrenches wherein legs, beams, cams and resilient means are used on different embodiments for accepting, retaining and releasing a nut inside a standard socket wrench to aid the user in the installation and removal of nuts and bolts in hard to reach places, specifically inside cavities where only a standard socket wrench extension can reach.

6 Claims, 3 Drawing Sheets

PREVIOUS ART

NUT AND BOLT HOLDER FOR SOCKET WRENCHES

This is a continuation-in-part of application 07/908,065 filed on Jul. 6, 1992, now abandoned.

FIELD OF INVENTION

The present invention relates to tools, specifically nut and bolt holders. Or nut holder has the capability of holding nuts and bolts inside sockets of socket wrenches.

The purpose is to help the user in the installation and removal of nuts and bolts in hard to reach places, specifically nuts and bolts mounted inside cavities where only an extension wrench can reach.

| REFERENCE CITED | | |
|---|---|---|
| 5,146,814 | Richard A. Vasichek | 6-3-1991 |
| 4,406,188 | Blaine N. Mills | 11-19-1981 |
| 4,787,273 | Donald J. Griffith | 9-29-1982 |
| 4,744,273 | William P. Bartok, Jr. | 6-8-1987 |
| 3,507,172 | James H. Smith | 11-28-1967 |
| 2,722,148 | Thomas M. Woyton | 12-6-1954 |
| 2,664,772 | Howard R. Elliott | 10-21-1949 |
| 4,939,959 | Stephen Rokita | 10-10-1989 |
| 3,232,148 | James C. Dearing | 6-3-1963 |
| 3,379,078 | W. J. Sallows | 7-28-1966 |
| 3,151,512 | W. Charczenko | 10-21-1960 |
| 3,145,595 | R. J. Mauck | 8-15-1963 |
| 2,770,157 | S. A. Moreo | 5-24-1954 |
| 2,367,480 | R. E. Beswick | 8-12-1940 |
| 2,273,861 | E. B. Green | 12-10-1940 |

BACKGROUND OF THE INVENTION

At the present time there are several types of fastener holders, Some are for holding nuts in open end wrenches, like U.S. Pat. No. 4,406,188—Blaine N. Mills and U.S. Pat. No. 4,787,273—Donald J. Griffith. These two devices are fine if the wrench has access to the nut from the side, but if the nut is inside a cavity where an open wrench can not reach, this tool would be useless.

The same applies to U.S. Pat. No. 3,507,172—James H. Smith, Pat. No. 2,722,148—Thomas M. Woyton and U.S. Pat. No. 2,664,772—Howard R. Elliot. These can only be used when the nut is accessible from the side by the wrench.

Other inventions like U.S. Pat. No. 4,939,959—Stephen Rokita, are designed to hold screws onto screw drivers. It is obvious that this tool can not help in the installation of nuts or bolts because nuts and bolts do not have grooves which are needed for a screw driver to perform its job.

Another device like U.S. Pat. No. 3,232,148—James C. Dearing, is a good tool to hold a nut in place when a bolt is screwed into a nut, but it can not be used to install a nut into a fixed stud.

With our invention, the same socket that rotates the nut and tightens the nut will have the capability of holding the nut or bolt in place during installation in hard to reach places, specifically inside cavities. Our tool does not need access from the side of the nut and it does not require getting the nut started with one tool and changing tools to tighten it with another tool, therefore saving time.

Our tool is excellent because it can be used with socket wrenches presently being used by mechanics.

SUMMARY

It is therefore an object of the present invention to provide a nut and bolt holder for socket wrenches which is capable of holding and releasing a nut inside the socket to aid the user in the installation and removal of nuts and bolts in hard to reach places. Our nut and bolt holder is specifically for nuts and bolts that are inside cavities where only socket wrench extensions can reach.

Although there are many embodiments of our invention the basic nut holder consists of a socket for socket wrenches containing a leg with a cam.

The socket has a longitudinal groove in the inner wall of the barrel. The leg is a thin, narrow, resilient member attached at the socket's driven end side, running inside the groove and extending slightly past an aperture at the socket's rim to allow a cover at the end of the leg to point outboard. This cover prevents dirt from getting inside the groove. The cam is attached inside the leg at the rim side of the socket and points toward the center of the socket. The purpose of this invention is to provide easy passage for the nut to the inside of the socket and once the nut is inside socket, the cam will provide sufficient support to hold the nut inside the socket. It will be somewhat easy for the wrench user to evacuate the nut when it is so desired by inserting the finger nail inside a notch that is located outside the cover and pulling the leg outboard to get the cam away from the nut's path.

BRIEF DESCRIPTION OF THE DRAWINGS

In the drawings:

FIG. 1 identifies the name of the parts that will be used throughout the invention description.

FIG. 3 is a partial view of FIG. 3.

DETAILED DESCRIPTION OF THE INVENTION

Figure 1:
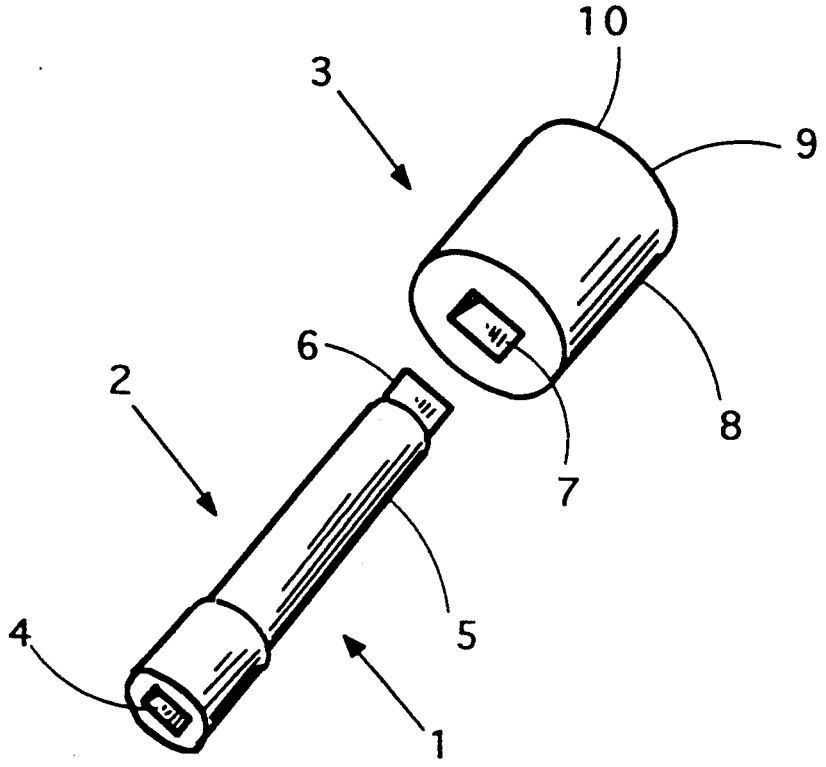
FIG. 1 is an isometric exploded view of a standard socket and standard extension of a socket wrench set.

Referring now in more detail and by reference characters to the drawing which illustrates practical embodiments of the present invention, FIG. 1 is an isometric exploded view of parts of a standard socket wrench set 1. FIG. 1 helps us identify names of parts of the previous arts that will be used throughout the invention description.

As shown in FIG. 1, socket wrench set 1 is comprised of an extension 2 and a socket 3.

Extension 2 is divided into three main parts: driven end hole 4, shaft 5, and shank 6.

Socket 3 is divided into three main parts: driven end hole 7, barrel 8, and rim 9. Socket's driven end hole 7 is a polygon shaped hole capable of slipping onto an extension 2 or onto a standard ratchet. Socket barrel 8 is a cylindrical shaped object with an internal polygon shaped cavity 10 capable of slipping over a nut, but built in a way that prevents the nut from spinning inside the polygon shaped cavity 10. Socket rim 9 is the edge of the barrel 8 where the nut enters the polygon shaped cavity 10.

Figure 3:
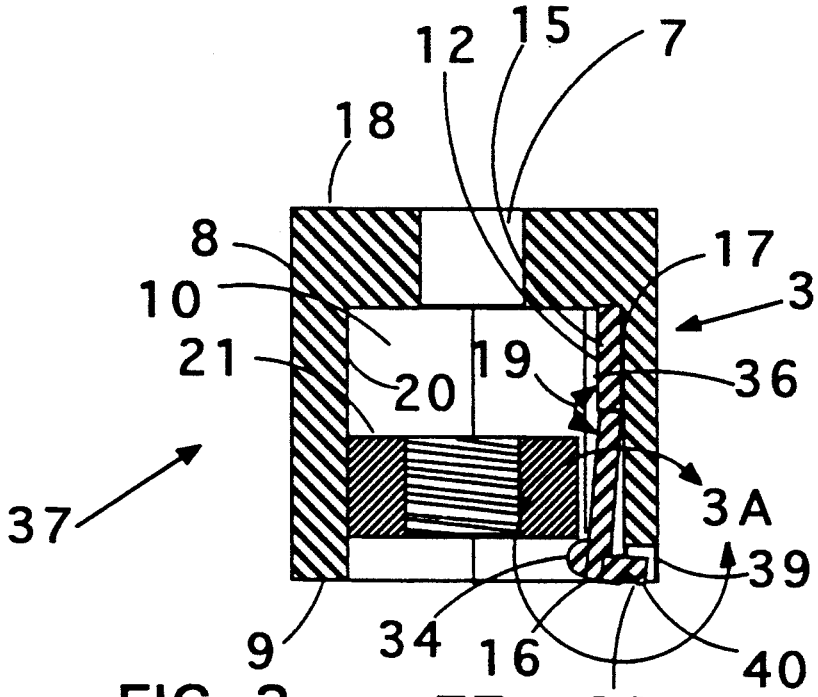
FIG. 3 is a cut of the device in FIG. 2.
Figure 3A:
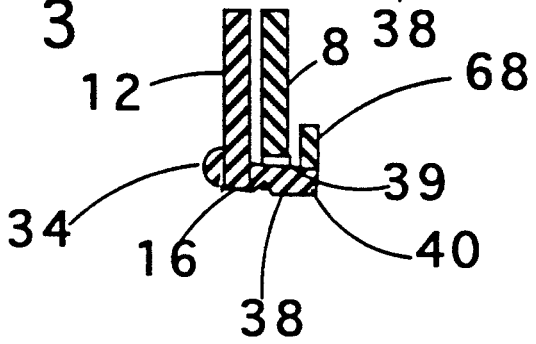
Figure 2:
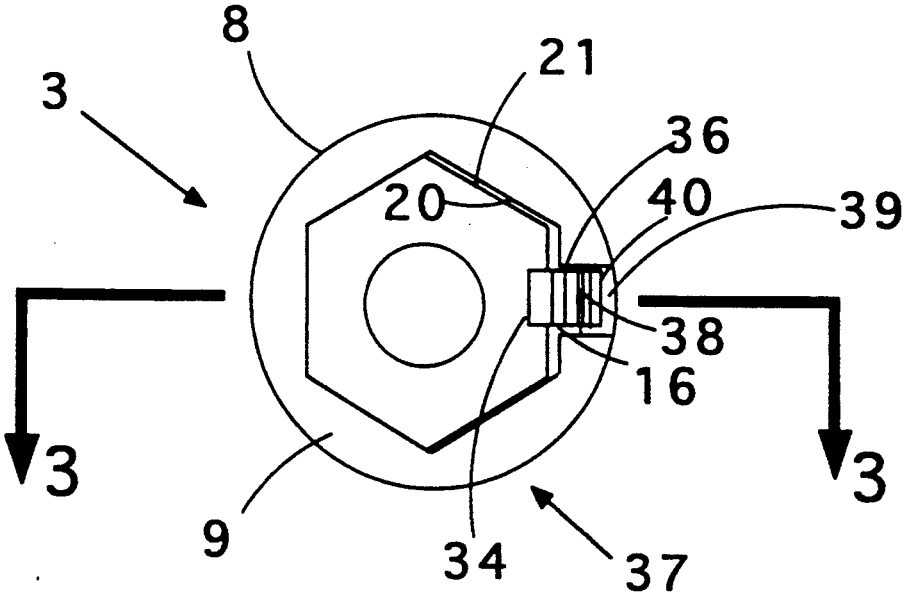
FIG. 2 is an end view of a nut and bolt holder socket for socket wrenches.

FIGS. 2 and 3 present nut and bolt holder socket 37. As shown in FIGS. 2 and 3, socket 3 has been modified by adding a longitudinal groove 36 to inner wall 20 inside of barrel 8 in the internal polygon shaped cavity 10. This groove 36 inside of barrel will allow an internal installation of cam 34 and leg 12. Leg 12 is thin and narrow member with two ends; leg end 15 and leg end 16. Leg 12 is attached firmly by joint 17 at leg end 15 to the inside of groove 36 at the socket's driven end side 18. Leg 12 runs along inside of groove 36 and stops before the edge of rim 9. A cam 34 is attached to the side of the leg end 16 of leg 12 and is pointing toward the center of socket 3. Leg 12 is made of a resilient material and spring bending action 19 between leg end 15 and leg end 16 is built into leg 12. Spring bending action 19 will have the tendency to force leg end 16 of leg 12 to move away from inner wall 20 and push cam 34 against nut 21 when nut 21 is inside the internal polygon shaped cavity 10.

This embodiment will allow cam 34 to move out of the nut's 21 path when inserting and removing nut 21 from inside the internal polygon shaped cavity 10 of socket 3, and of course the cam 34 is capable of holding nut 21 inside the internal polygon shaped cavity 10.

In addition, an aperture 39 has been added to the edge of rim 9 to allow the passage of a cover 40 which is outboard at the end of leg 12. This cover 40 extends from the side of leg end 16 behind cam 34 to at least all the way to the inner wall 20 of barrel 8. Cover 40 is to prevent foreign objects from entering between groove 36 and the back of leg end 16 when resilient means 19 is relaxed. When nut 21 is sliding past cam 34 and leg 16 and cam 34 moves outboard toward the bottom of groove 36, cover 40 will go into aperture 39.

In addition, a small notch 38 has been added to the external side of cover 40 to allow the user's fingernail to be inserted into notch 38 to help pull leg 12 and cam 34 away from nut 21 when the user wishes to release nut 21 from the internal polygon shaped cavity 10.

FIG. 3 is a partial view of FIG. 3 and it presents an alternative embodiment of the device in FIG. 3. This embodiment adds a leg 68 to the end of cover 40. Leg 68 is a short member, perpendicular or near perpendicular to cover 40 and it runs parallel or near parallel to barrel 8 pointing toward socket driven end side 18. The purpose of leg 68 is to keep cam 34 and leg end 16 from going too far into the center of the internal polygon shaped cavity 10 where it can get in the path of nut 21.

Figure 4:
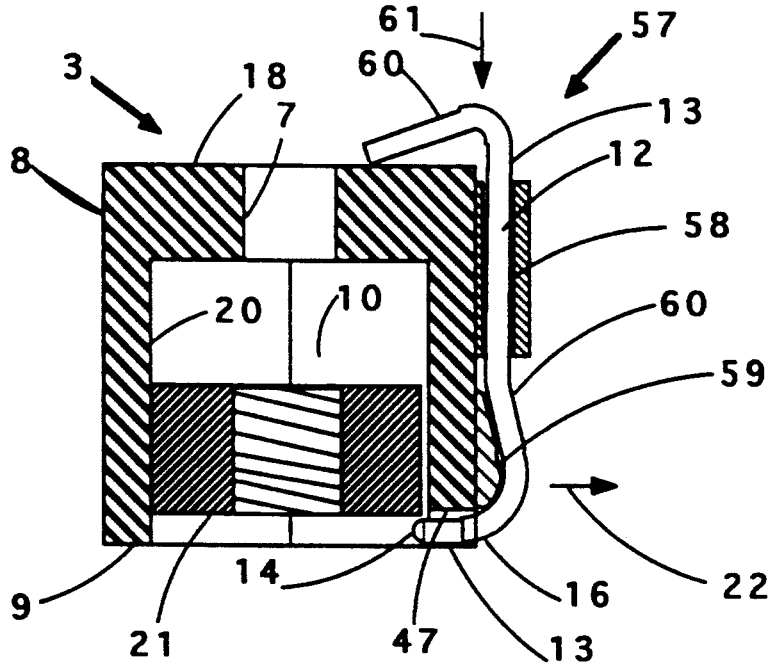
FIG. 4 is a cut view of an alternative embodiment of a nut and bolt holder socket for socket wrenches.

FIG. 4 presents nut and bolt holder 57, another embodiment of our invention. As shown in FIG. 4, socket 3 has been modified by adding a ramp 58 to the side of barrel 8 at the socket driven side 18, and a cam 59 at the rim 9 side of barrel 8. Ramp 58 is designed to grip and allow the axial sliding movement of leg 12. This leg 12 is a thin, narrow, resilient member with two ends. The socket driven end side 18 of leg 12 has a resilient beam member 60 extending inboard toward driven end hole 7 but short enough not to reach driven end hole 7 and to prevent interference with standard extension 2 (not shown). The other leg end 16, of leg 12, has a curvature 60, riding cam 59 and a beam 13 going through aperture 47, located on the edge of rim 9. Beam 13 extends inboard all the way to inner wall 20 of barrel 8. At the end of beam 13, a cam 14 is included for the purpose of providing easy passage and sufficient support for nut 21 inside socket 3. This is also done to aid the wrench user in the installation and removal of nuts and bolts in hard to reach places by preventing the user from dropping the nut during nut installation and removal. With this embodiment, when an axial force 61 is applied to resilient member 60, leg 12 will slide axially through ramp 58, causing curvature 60 of leg 12 to ride over cam 59. This riding of leg 12 over cam 59, will cause an outboard motion 22. This outboard motion 22, will give beam 13 and cam 14 an outboard motion, getting cam 14 out of nut's 21 path to help the evacuation of the nut 21 from inside the internal polygon shaped cavity 10 of socket 3. After nut 21 has evacuated socket 3, the resilient member 60 will force the chain of events to be reversed after the axial force 61 is released.

This invention has been thoroughly tested and found to be completely satisfactory for the accomplishments of the above objects. While I have shown in preferred embodiments thereof I wish it to be specifically understood that the same may be modified. For example, cam 14 can be round, wedge elliptical, parabolic, etc., or any kind of cam shape that will force beam 13 out of the path of nut 21. Of course, the less steep cam 14 is, the less force will be needed to pull nut 21 from inside socket 3. Leg 12 can be of many shapes and of numerous cross sectional areas. For example, the cross sectional area can be square, triangular, round, elliptical, etc.

The most important part of the cross sectional area of leg 12 is that a small area moment of inertia is preferable to have the weakest spring as possible. A strong spring will require a large axial force to evacuate nut 21. This may cause socket 3 from separating from the standard extension 2.

The complete leg 12 does not have to be resilient. All that is needed is a resilient cam of some sort of rubber like material attach to beam 13 which will give in as nut 21 is going by. Basically any component of the nut holder that is resilient enough to allow cam 14 to be moved out of the path of nut 21 will do the job.

For example, beam 13 can be resilient and deflect as nut 21 goes by. It is possible but not necessary to have multiple legs 12, beams 13 and cams 14 surrounding socket 3.

Our nut holders are also capable of being installed on standard breaker bar wrenches and ratchet wrenches, not just on standard extensions. Although, if a ratchet is used during nut installation, the probability is that the nut can be started with the user's fingers.

Although we call our tool a Nut And Bolt Holder it is important to point out that this tool is excellent for installing and removing spark plugs.

Leg 12 does not have to stop before the edge of rim 9, although it will be foolish to allow leg 12 to prevent rim 9 from touching the surface of attachment.

Having thus described our invention, what we claim is new and desire to secure by United States Letter Patent is:

1. A nut and bolt holder socket (37) for standard socket wrenches to aid the wrench user in the installation and removal of nuts and bolts in hard to reach places comprising of:

a socket (3) with a driven polygon shaped end hole (7), a barrel (8) with an internal polygon shaped cavity (10) and a rim (9), said driven polygon shaped end hole (7) capable of slipping onto shank (6) of a standard extension (2), said internal polygon shaped cavity (10) capable of slipping over a nut (21), a longitudinal groove (36) in an inner wall (20) of said socket (3), a leg (12) which is attached firmly to the inside of said longitudinal groove (36), running along inside of said longitudinal groove (36) without interfering with said nut (21) that is being driven inside said socket (3), a cam (34) on a side of a leg end (16) of said leg (12) and pointing inboard to the center axis of said socket (3), providing sufficient support to hold said nut (21) inside said socket (3), said cam (34) can also be pushed out of said nut's (21) path as said nut (21) slides by said cam (34) during extraction and insertion of said nut (21), a resilient means to allow said cam (34) to be pushed out of said nut's (21) path and cause said cam (34) to go back to its original position after said nut (21) has passed by, an aperture (39) on an edge of said rim (9) of said socket (3), a cover (40) which is attached outboard to the end of said leg (12) and extending all the way to an inner wall (20) of said barrel (8) when said resilient means is unsprung and said cover (40) extends through said aperture (39) when said cam (34) moves outboard as said nut (21) slides by.

2. A nut and bolt holder socket of claim 1 wherein:

an additional groove (36), leg (12), cam (34) and cover (40) on the inside of said socket (37) opposite to the longitudinal groove (36), and its respective leg (12) and cam (34) making a symmetrical nut and bolt holder socket to help diminish the size of said cams.

3. A nut and bolt holder socket of claim 1 wherein:

a notch (38) on an external side of said cover (40) to allow the user's fingernail to be inserted into said notch (38) to help pull said leg (12) and said cam (34) away from said nut (21) when the user wishes to release said nut (21) from said internal polygon shaped cavity (10).

4. A nut and bolt socket of claim 1 wherein:

a leg (68) attached to said cover (40), running near parallel to said barrel (8) and pointing toward a driven end of said socket (3) for the purpose of keeping said cam (34) and said leg end (16) from going too far into the center of said internal polygon shaped cavity (10) where it can get in the path of said nut (21).

5. A nut and bolt holder socket (57) for standard socket wrenches to aid the wrench user in the installation and removal of nuts and bolts in hard to reach places comprising of:

a socket (3) with a driven polygon shaped end hole (7), a barrel (8) with an internal polygon shaped cavity (10) and a rim (9), said driven polygon shaped end hole (7) capable of slipping onto shank (6) of a standard extension (2), said internal polygon shaped cavity (10) capable of slipping over a nut (21), a first ramp (58) attached firmly to said barrel (8) of said socket (3), a leg (12) slidable inside first ramp (58), running along side of said barrel (8) of said socket (3), said leg (12) extending to an aperture (47) on an edge of said rim (9) of said socket (3), a beam (13) which is inboard at an end of said leg (12) and extending all the way to an inner wall (20) of said barrel (8) through said aperture (47), a first cam (14) attached inboard to said beam (13), providing sufficient support to hold said nut (21) inside said socket (3), said cam (14) can also be pushed out of said nut's (21) path as said nut (21) slides by said cam (14) during extraction and insertion of said nut (21), a resilient means to allow said cam (14) to be pushed out of said nut's (21) path and cause said cam (14) to go back to its original position after said nut (21) has passed by, a second resilient member (60) attached inboard to said leg (12) at driven end side (18) of said socket (3), a second cam (59) attached on the exterior of said barrel (8) of said socket (3) to create an outboard motion (22) of said leg (12) and said first cam (14) when an axial force (61) is applied to said second resilient member (60) causing said leg (12) to slide through said ramp (58) to help release said nut (21) from inside said socket (3).

6. A nut and bolt holder socket of claim 5 wherein:

an additional ramp (58), aperture (47), leg (12), beam (13), first cam (14), second resilient member (60) and second cam (59) on said socket (57) opposite to the first ramp (58) and its respective aperture (47), leg (12), beam (13), first cam (14), second resilient member (60) and second cam (59) making a symmetrical nut and bolt holder socket to help diminish the size of said cams.

* * * * *